US011459703B2

(12) United States Patent
Higuchi et al.

(10) Patent No.: US 11,459,703 B2
(45) Date of Patent: Oct. 4, 2022

(54) SHEET MANUFACTURING APPARATUS, CONTROL METHOD THEREOF, AND SHEET MANUFACTURING METHOD

(71) Applicant: SEIKO EPSON CORPORATION, Tokyo (JP)

(72) Inventors: Naotaka Higuchi, Nagano (JP); Yoshihiro Ueno, Nagano (JP); Kiyoshi Tsujino, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 539 days.

(21) Appl. No.: 16/490,239

(22) PCT Filed: Feb. 27, 2018

(86) PCT No.: PCT/JP2018/007125
§ 371 (c)(1),
(2) Date: Aug. 30, 2019

(87) PCT Pub. No.: WO2018/159578
PCT Pub. Date: Sep. 7, 2018

(65) Prior Publication Data

US 2020/0002894 A1 Jan. 2, 2020

(30) Foreign Application Priority Data

Mar. 1, 2017 (JP) ..... JP2017-038000
Feb. 16, 2018 (JP) ..... JP2018-025778

(51) Int. Cl.
*D21H 21/28* (2006.01)
*D04H 1/425* (2012.01)
(Continued)

(52) U.S. Cl.
CPC ..... *D21H 21/28* (2013.01); *D04H 1/425* (2013.01); *D04H 1/60* (2013.01); *D04H 1/732* (2013.01);
(Continued)

(58) Field of Classification Search
CPC ..... D21H 21/28; D21H 23/20; D21H 27/42; D04H 1/425; D04H 1/60; D04H 1/732;
(Continued)

(56) References Cited

U.S. PATENT DOCUMENTS

2014/0290884 A1* 10/2014 Yamagami ..... D21H 23/06 162/158
2014/0374047 A1* 12/2014 Yamagami ..... D21B 1/08 162/261
(Continued)

FOREIGN PATENT DOCUMENTS

JP 2004-361852 A 12/2004
JP 2014-208922 A 11/2014
(Continued)

*Primary Examiner* — Jacob T Minskey
*Assistant Examiner* — Matthew M Eslami
(74) *Attorney, Agent, or Firm* — Global IP Counselors, LLP

(57) ABSTRACT

The sheet manufacturing apparatus includes a fibrillating unit that fibrillates a raw material including fibers in a gas, an additive supply unit that supplies an additive, a mixing unit including a first rotating unit that mixes a fibrillated matter fibrillated by the fibrillating unit and the additive supplied by the additive supply unit, a depositing unit that deposits a mixture mixed by the mixing unit, a web forming unit including a mesh belt that transports a deposited material deposited by the depositing unit and a suction mechanism that sucks the deposited material to the mesh belt, and a control unit that changes granularity of a surface of the sheet by controlling at least one of a supply amount per unit time from the additive supply unit, a rotation velocity of the first rotating unit of the mixing unit, and a suction force of the suction mechanism.

8 Claims, 2 Drawing Sheets

(51) Int. Cl.

| | |
|---|---|
| ***D04H 1/60*** | (2006.01) |
| ***D04H 1/732*** | (2012.01) |
| ***D21B 1/08*** | (2006.01) |
| ***D21F 7/08*** | (2006.01) |
| ***D21F 9/00*** | (2006.01) |
| ***D21H 23/20*** | (2006.01) |

(52) U.S. Cl.
CPC ..... *D21B 1/08* (2013.01); *D21F 7/086* (2013.01); *D21F 9/00* (2013.01); *D21H 23/20* (2013.01)

(58) Field of Classification Search
CPC ..... D04H 1/4274; D04H 1/736; D21B 1/08; D21F 7/086; D21F 9/00; D21G 9/0027; B27N 3/04
See application file for complete search history.

(56) References Cited

U.S. PATENT DOCUMENTS

| | | | |
|---|---|---|---|
| 2016/0230320 | A1 | 8/2016 | Ueno et al. |
| 2016/0332325 | A1 | 11/2016 | Murayama et al. |

FOREIGN PATENT DOCUMENTS

| | | | |
|---|---|---|---|
| JP | 2015-092032 | A | 5/2015 |
| JP | 2015-161035 | A | 9/2015 |

* cited by examiner

SHEET MANUFACTURING APPARATUS, CONTROL METHOD THEREOF, AND SHEET MANUFACTURING METHOD

CROSS-REFERENCE TO RELATED APPLICATIONS

This application is a U.S. National stage application of International Patent Application No. PCT/JP2018/007125, filed on Feb. 27, 2018, which claims priority under 35 U.S.C. § 119(a) to Japanese Patent Application No. 2017-038000, filed in Japan on Mar. 1, 2017 and Japanese Patent Application No. 2018-025778, filed in Japan on Feb. 16, 2018. The entire disclosures of Japanese Patent Application Nos. 2017-038000 and 2018-025778 are hereby incorporated herein by reference.

TECHNICAL FIELD

The present invention relates to a sheet manufacturing apparatus, a control method thereof, and a sheet manufacturing method.

BACKGROUND ART

Depositing fibrous material, and obtaining a sheet-like or film-like formed body by applying a binding force between the deposited fibers, have long been performed. Its typical example is to manufacture a paper by paper making (papermaking) using water. Even now, the paper making method is widely used as one of the methods of manufacturing paper. The paper manufactured by the paper making method tends to have a structure where cellulosic fibers derived from, for example, wood or the like, intertwine together and form hydrogen-bonds and further the fibers are partially bound together by binder (paper strengthening agent (starch paste, water-soluble resin, or the like)).

However, the paper making method is a wet method, so that a large amount of water needs to be used and dehydration or drying is required after the paper is formed. Therefore, energy and time consumed for these processes are very large. Further, the used water needs to be appropriately processed as discharge water. Furthermore, an apparatus used for the paper making method often requires large-scale utility and infrastructure such as water, power, and drainage facilities, so that it is difficult to reduce the size of the apparatus.

Therefore, from viewpoints of energy saving and environmental protection, a method called a dry method that hardly uses water is expected as a paper manufacturing method which will be used instead of the paper making method. For example, Japanese Unexamined Patent Application Publication No. 2015-161035 discloses an apparatus that forms a sheet such as paper by a dry process.

A sheet manufacturing apparatus described in Japanese Unexamined Patent Application Publication No. 2015-161035 has a classification unit, a mixing unit, a depositing unit, a forming unit, and the like. A cited literature 1 describes that characteristics such as thickness and density of a sheet to be manufactured can be changed by changing a condition of at least one of the classification unit, the mixing unit, the depositing unit, and the forming unit. For example, there is a description indicating that strength and density of the sheet to be manufactured can be changed by changing fiber lengths of a fibrillated matter passing through a sieve by changing a rotation velocity of the sieve with a drum shape in the depositing unit.

However, it is considered to be difficult to control a roughness feeling of the sheet to be manufactured to a predetermined state even if various sheets can be manufactured.

SUMMARY

One of objects according to some aspects of the present invention is to provide a sheet manufacturing apparatus, a control method thereof, or a sheet manufacturing method, which can adjust a roughness feeling (granularity) of an appearance of a sheet and can stably manufacture a sheet with a given roughness feeling.

The present invention is made to solve at least a part of the problems described above and can be implemented as aspects or application examples described below.

An aspect of a sheet manufacturing apparatus according to the present invention includes a fibrillating unit that fibrillates a raw material including fibers in a gas, an additive supply unit that supplies an additive, a mixing unit including a first rotating unit that mixes a fibrillated matter fibrillated by the fibrillating unit and the additive supplied by the additive supply unit, a depositing unit that deposits a mixture mixed by the mixing unit, a web forming unit including a mesh belt that transports a deposited material deposited by the depositing unit and a suction mechanism that sucks the deposited material to the mesh belt, and a control unit that changes granularity of a surface of the sheet by controlling at least one of a supply amount per unit time from the additive supply unit, a rotation velocity of the first rotating unit of the mixing unit, and a suction force of the suction mechanism.

According to such a sheet manufacturing apparatus, it is possible to adjust granularity of the surface of the sheet (roughness feeling of an appearance of the sheet) and manufacture a sheet with a given roughness feeling.

In the sheet manufacturing apparatus according to the present invention, a receiving unit that receives a setting of the granularity of the surface of the sheet is included, and the control unit may control at least one of the supply amount per unit time from the additive supply unit, the number of rotations of the first rotating unit of the mixing unit, and the suction force of the suction mechanism based on the setting received by the receiving unit.

According to such a sheet manufacturing apparatus, when a user sets a granularity of a surface of a sheet to the receiving unit, it is possible to easily manufacture a sheet having the granularity.

In the sheet manufacturing apparatus according to the present invention, the depositing unit has a drum unit that causes the mixture to pass through an opening and fall, and the control unit may change a rotation velocity of the drum unit.

According to such a sheet manufacturing apparatus, when the additive includes a color material, it is possible to easily change the granularity of the surface of the sheet to be manufactured.

In the sheet manufacturing apparatus according to the present invention, the fibrillating unit has a second rotating unit for fibrillating the raw material, and the control unit may change a rotation velocity of the second rotating unit.

According to such a sheet manufacturing apparatus, it is possible to easily change the granularity of the surface of the sheet to be manufactured.

In the sheet manufacturing apparatus according to the present invention, the suction mechanism has a first air flow generation unit that generates an air flow in a direction crossing a deposition surface where the deposited material is deposited, and the control unit may change a flow velocity of the air flow generated by the first air flow generation unit.

According to such a sheet manufacturing apparatus, it is possible to easily change the granularity of the surface of the sheet to be manufactured.

In the sheet manufacturing apparatus according to the present invention, a transportation unit that transports the deposited material deposited by the depositing unit is included, the transportation unit has a second air flow generation unit that generates an air flow in a direction crossing a deposition surface where the deposited material is deposited, and the control unit may change a flow velocity of the air flow generated by the second air flow generation unit.

According to such a sheet manufacturing apparatus, it is possible to easily change the granularity of the surface of the sheet to be manufactured.

In the sheet manufacturing apparatus according to the present invention, the additive may include a color material.

According to such a sheet manufacturing apparatus, it is possible to easily change the granularity of the surface of the sheet to be manufactured while coloring the sheet.

An aspect of a control method of a sheet manufacturing apparatus according to the present invention is a control method of a sheet manufacturing apparatus including a fibrillating unit that fibrillates a raw material including fibers in a gas, an additive supply unit that supplies an additive, a mixing unit including a first rotating unit that mixes a fibrillated matter fibrillated a depositing unit that deposits a mixture mixed by the mixing unit, and a web forming unit including a mesh belt that transports a deposited material deposited by the depositing unit and a suction mechanism that sucks the deposited material to the mesh belt, and the control method includes changing granularity of a surface of the sheet by controlling at least one of a supply amount per unit time from the additive supply unit, a rotation velocity of the first rotating unit of the mixing unit, and a suction force of the suction mechanism.

According to such a control method of a sheet manufacturing apparatus, it is possible to adjust granularity of the surface of the sheet (roughness feeling of an appearance of the sheet) and manufacture a sheet with a desired roughness feeling.

An aspect of a sheet manufacturing method according to the present invention has a fibrillating step of fibrillating a raw material including fibers in a gas and obtaining a fibrillated matter, an additive supplying step of supplying an additive to the fibrillated matter, a mixing step of mixing the fibrillated matter and the additive by using a first rotating unit and obtaining a mixture, and a depositing step of obtaining a deposited material by depositing the mixture while sucking the mixture to a mesh belt, and a granularity of a surface of the sheet is changed by changing at least one of a supply amount per unit time from the additive supply unit, a rotation velocity of the first rotating unit of the mixing unit, and a suction force to the mesh belt.

According to such a sheet manufacturing method, it is possible to adjust granularity of the surface of the sheet (roughness feeling of an appearance of the sheet) and manufacture a sheet with a desired roughness feeling.

DESCRIPTION OF EMBODIMENTS

Hereinafter, some embodiments of the present invention will be described. The embodiments described below describe an example of the present invention. The present invention is not limited at all by the embodiments below. The present invention includes various modified examples implemented within a scope not changing the gist of the present invention. All of the configurations described below are not necessarily essential components of the present invention.

1. Overview of Manufacturing Apparatus

Figure 1:
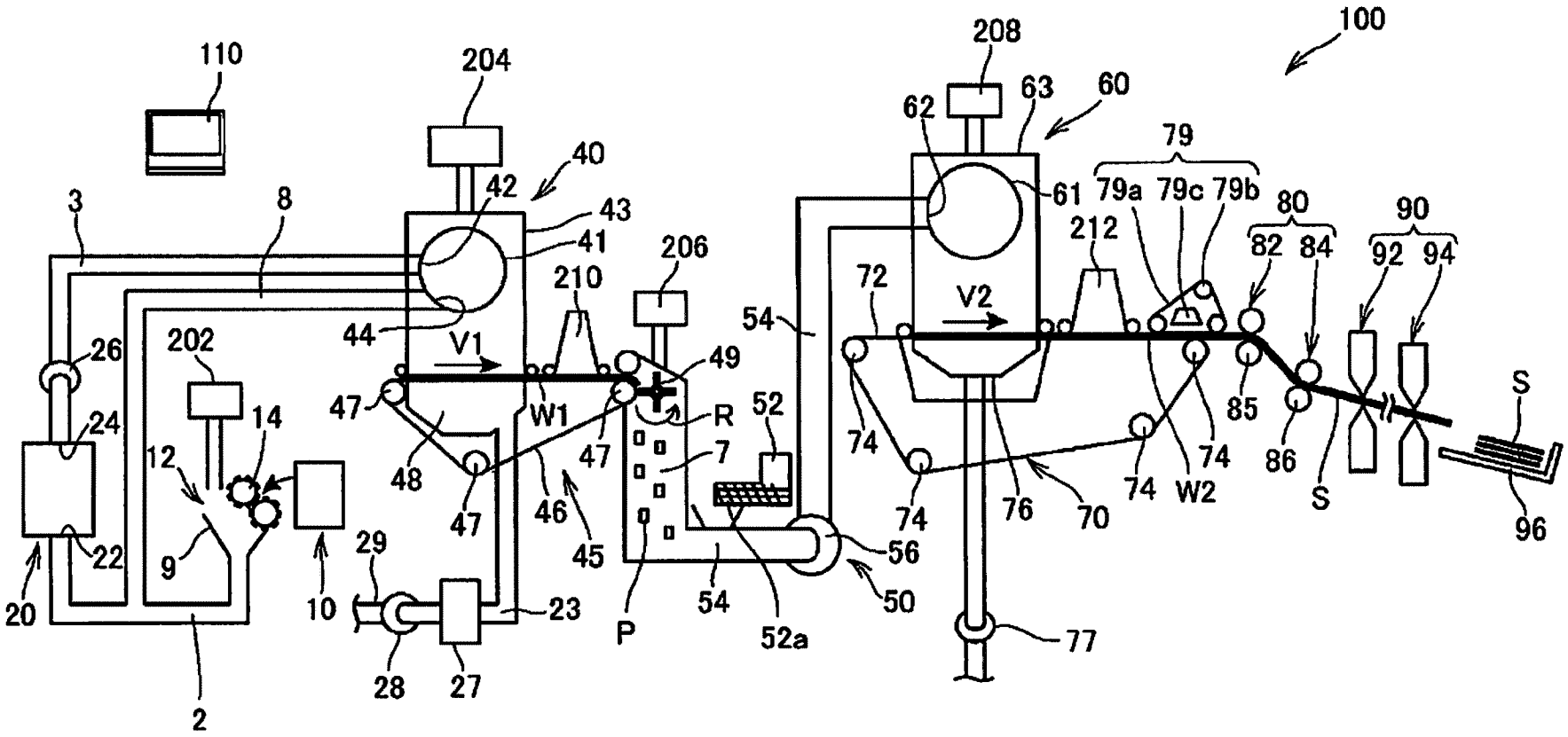
FIG. 1 is a schematic diagram showing a configuration of a sheet manufacturing apparatus according to an embodiment.

FIG. 1 is a schematic diagram showing a configuration of a sheet manufacturing apparatus 100 according to an embodiment.

The sheet manufacturing apparatus 100 described in the present embodiment is, for example, an apparatus suitable for manufacturing new paper by dry-fibrillating and fiberizing used waste paper such as confidential paper used as raw material and thereafter pressurizing, heating, and cutting the paper. Bond strength and/or whiteness of a paper product may be improved, and functions such as color, aroma, and flame retardancy may be added, according to uses by mixing various additives to a fiberized raw material. Further, it is possible to manufacture papers of various thickness and sizes such as office papers of A4 and A3 and a name card paper according to uses by forming the paper while controlling density, thickness, and shape of the paper.

The sheet manufacturing apparatus 100 includes a supply unit 10, a rough-crushing unit 12, a fibrillating unit 20, a selection unit 40, a first web forming unit 45, a rotating body 49, a mixing unit 50, a depositing unit 60, a second web forming unit 70, a transportation unit 79, a sheet forming unit 80, a cutting unit 90, and a control unit 110.

Further, the sheet manufacturing apparatus 100 includes humidifying units 202, 204, 206, 208, 210, and 212 in order to humidify a raw material and/or a space where a raw material moves.

Specific configurations of the humidifying units 202, 204, 206, 208, 210, and 212 are optional, and examples of the configurations include a steam type, a vaporizing type, a hot air vaporizing type, and an ultrasonic type.

In the present embodiment, the humidifying units 202, 204, 206, and 208 are composed of a vaporizing type or a hot air vaporizing type humidifier. Specifically, the humidifying units 202, 204, 206, and 208 have a filter infiltrated with water (not shown in the drawings) and supplies humidified air whose humidity is increased by causing air to pass through the filter. The humidifying units 202, 204, 206, and 208 may have a heater (not shown in the drawings) that effectively increases humidity of the humidified air.

In the present embodiment, the humidifying unit 210 and the humidifying unit 212 are composed of an ultrasonic type humidifier. Specifically, the humidifying units 210 and 212 have a vibration unit (not shown in the drawings) that atomizes water, and supplies mist generated by the vibration unit.

The supply unit 10 supplies raw material to the rough-crushing unit 12. Raw material where the sheet manufacturing apparatus 100 manufactures a sheet may be a material containing fibers, and examples of the raw material include paper, pulp, pulp sheet, cloth including nonwoven fabric, and fabric. In the present embodiment, a configuration where the sheet manufacturing apparatus 100 uses waste papers as raw material is illustrated. For example, the supply unit 10 may have a configuration including a stacker that piles up and accumulates waste papers and an automatic feeding apparatus that feeds out waste papers from the stacker to the rough-crushing unit 12.

The rough-crushing unit 12 cuts (roughly crushes) the raw material supplied from the supply unit 10 into roughly crushed pieces by using rough-crushing blades 14. The rough-crushing blades 14 cuts the raw material in a gas such as in the atmosphere (in the air). The rough-crushing unit 12 includes, for example, the pair of rough-crushing blades 14 that pinch and cut the raw material and a drive unit that rotates the rough-crushing blades 14, so that the rough-crushing unit 12 can have a configuration similar to that of a shredder. The shape and the size of the roughly crushed pieces are optional, and may be suitable for fibrillation processing in the fibrillating unit 20. The rough-crushing unit 12 cuts the raw material into paper pieces having sizes of one to several cm square or less.

The rough-crushing unit 12 has a chute (hopper) 9 that receives roughly crushed pieces that are cut and dropped by the rough-crushing blades 14. The chute 9 has, for example, a tapered shape whose width gradually decreases in a direction in which the roughly crushed pieces flow (proceed). Therefore, the chute 9 can receive many roughly crushed pieces. The chute 9 is connected with a pipe 2 communicating with the fibrillating unit 20. The pipe 2 forms a transportation path for causing the fibrillating unit 20 to transport the raw material (roughly crushed pieces) cut by the rough-crushing blades 14. The roughly crushed pieces are gathered by the chute 9 and transferred (transported) to the fibrillating unit 20 through the pipe 2. The roughly crushed pieces are transported in the pipe 2 toward the fibrillating unit 20 by an air flow generated by a blower (not shown in the drawings).

Humidified air is supplied by the humidifying unit 202 to the chute 9 included in the rough-crushing unit 12 or a vicinity of the chute 9. Thereby, it is possible to suppress a phenomenon in which the roughly crushed pieces cut by the rough-crushing blades 14 are adsorbed to inner surfaces of the chute 9 and/or the pipe 2 by static electricity. Further, the roughly crushed pieces cut by the rough-crushing blades 14 are transferred to the fibrillating unit 20 along with humidified air (of high humidity), so that it is possible to expect an effect of suppressing adhesion of a fibrillated matter inside the fibrillating unit 20. The humidifying unit 202 may be configured to supply humidified air to the rough-crushing blades 14 and eliminate electricity from the raw material supplied from the supply unit 10.

The electricity may be eliminated by using an ionizer along with the humidifying unit 202.

The fibrillating unit 20 fibrillates the roughly crushed pieces cut by the rough-crushing unit 12. More specifically, the fibrillating unit 20 performs fibrillation processing on the raw material (roughly crushed pieces) cut by the rough-crushing unit 12 and generates a fibrillated matter.

Here, "to fibrillate" means to untangle a raw material (material to be fibrillated), where a plurality of fibers are bound together, into fibers separated from each other. The fibrillating unit 20 also has a function to separate substances such as resin particles, ink, toner, and blot inhibitor, which are attached to the raw material, from the fibers.

A matter that has passed through the fibrillating unit 20 is called a "fibrillated matter". The "fibrillated matter" may include resin particles separated from fibers when the fibers are untangled (resin particles for binding a plurality of fibers together), a color material such as ink or toner, and additive agents such as a blot inhibitor and a paper strengthening agent, in addition to the untangled fibrillated fibers. An untangled fibrillated matter has a string shape or a ribbon shape. An untangled fibrillated matter may exist in a state (an independent state) of not being intertwined with other untangled fibers, or may exist in a state where an untangled fibrillated matter is tangled with other untangled fibrillated matter and forms a lump shape (a state where a so-called "agglomerate" is formed).

The fibrillating unit 20 performs dry-type fibrillation. Here, fibrillation performed in a gas such as in the atmosphere (in the air) instead of in liquid is referred to as dry-type fibrillation. In the present embodiment, the fibrillating unit 20 uses an impeller mill. Specifically, the fibrillating unit 20 includes a rotor (not shown in the drawings) rotating at high speed and a liner (not shown in the drawings) located on an outer circumference of the rotor. The roughly crushed pieces cut by the rough-crushing unit 12 are sandwiched between the rotor and the liner of the fibrillating unit 20 and fibrillated. The fibrillating unit 20 generates an air flow by rotation of the rotor. By this air flow, the fibrillating unit 20 can suck the roughly crushed pieces, which are raw material, from the pipe 2 and transport the fibrillated matter to a discharge port 24. The fibrillated matter is sent out from the discharge port 24 to the pipe 3 and transferred to the selection unit 40 through the pipe 3.

In this way, the fibrillated matter generated in the fibrillating unit 20 is transported from the fibrillating unit 20 to the selection unit 40 by the air flow generated by the fibrillating unit 20. Further, in the present embodiment, the sheet manufacturing apparatus 100 includes a fibrillating unit blower 26, which is an air flow generating apparatus, and the fibrillated matter is transported to the selection unit 40 by the air flow generated by the fibrillating unit blower 26. The fibrillating unit blower 26 is attached to the pipe 3. The fibrillating unit blower 26 sucks air along with the fibrillated matter from the fibrillating unit 20 and sends the air to the selection unit 40.

The selection unit 40 has an introduction port 42 through which the fibrillated matter fibrillated by the fibrillating unit 20 flows in along with the air flow from the pipe 3. The selection unit 40 selects the fibrillated matter introduced to the introduction port 42 according to the lengths of fibers. Specifically, regarding the fibrillated matter fibrillated by the fibrillating unit 20, the selection unit 40 selects fibrillated matter whose size is smaller than or equal to a predetermined size as a first selected matter, and selects fibrillated matter whose size is greater than the first selected matter as a second selected matter. The first selected matter includes fibers, particles, or the like, and the second selected matter includes, for example, large fibers, unfibrillated pieces (roughly crushed pieces that are not sufficiently fibrillated), agglomerates where fibrillated fibers clump together or intertwined with each other, and the like.

In the present embodiment, the selection unit 40 has a drum unit (sieving unit) 41 and a housing portion (cover portion) 43 that houses the drum unit 41.

The drum unit 41 is a cylindrical sieve rotationally driven by a motor. The drum unit 41 has a net (filter, screen) and functions as a sieve. By meshes of the net, the drum unit 41 selects the first selected matter that is smaller than the size of the mesh (opening) of the net and the second selected matter that is greater than the size of the mesh (opening) of the net. As the net of the drum unit 41, it is possible to use, for example, a metal net, an expanded metal made by expanding a metal plate having cut lines, and a punching metal made by forming holes in a metal plate by a pressing machine or the like.

The fibrillated matter introduced to the introduction port 42 is sent inside the drum unit 41 along with the air flow, and the first selected matter falls downward from the meshes of the net of the drum unit 41 by the rotation of the drum unit 41. The second selected matter that cannot pass through the meshes of the net of the drum unit 41 is introduced to a discharge port 44 by being flown by the air flow flown from the introduction port 42 to the drum unit 41 and sent out to a pipe 8.

The pipe 8 connects the inside of the drum unit 41 with the pipe 2. The second selected matter flown through the pipe 8 flows through the pipe 2 along with the roughly crushed pieces cut by the rough-crushing unit 12 and is introduced to an introduction port 22 of the fibrillating unit 20. Thereby, the second selected matter is returned to the fibrillating unit 20 and subjected to the fibrillation processing.

The first selected matter selected by the drum unit 41 is dispersed to the air through the meshes of the net of the drum unit 41, and falls toward a mesh belt 46 of the first web forming unit 45 located below the drum unit 41.

The first web forming unit 45 (separation unit) includes the mesh belt 46 (separation belt), rollers 47, and a suction unit (suction mechanism) 48. The mesh belt 46 is an annular belt (endless-shaped belt). The mesh belt 46 is suspended by three rollers 47 and transported in a direction indicated by an arrow shown in FIG. 1 by movement of the rollers 47. A surface of the mesh belt 46 is formed of a net where openings of a predetermined size are arranged. In the first selected matter falling from the selection unit 40, microparticles having a size that can pass through the meshes of the net fall below the mesh belt 46 and fibers having a size that cannot pass through the meshes of the net are deposited on the mesh belt 46 and transported in the arrow direction along with the mesh belt 46. The microparticles that fall from the mesh belt 46 includes fibrillated matter whose size is relatively small or whose density is low (resin particles, color materials, additive agents, and the like), and the microparticles are matter to be eliminated, which is not used to manufacture a sheet S.

The mesh belt 46 moves at a constant velocity V1 during a normal operation in which the sheet S is manufactured. Here, "during a normal operation" is "during an operation other than starting control and stopping control of the sheet manufacturing apparatus 100 described later", and more specifically is "during a period in which the sheet manufacturing apparatus 100 manufactures a sheet S of a desired quality".

Therefore, the fibrillated matter subjected to the fibrillation processing in the fibrillating unit 20 is selected into the first selected matter and the second selected matter, and the second selected matter is returned to the fibrillating unit 20. Further, the matter to be eliminated is eliminated from the first selected matter by the first web forming unit 45. The first selected matter other than the matter to be eliminated is a material suited to manufacturing of the sheet S, and the material is deposited on the mesh belt 46 and forms a first web W1. The first web forming unit 45 can be regarded as a part of the selection unit 40 in a point that the first web forming unit 45 separates the second selected matter from the fibrillated matter and separates the matter to be eliminated from the first selected matter.

The suction unit 48 sucks air from below the mesh belt 46. The suction unit 48 is connected to a dust collection unit 27 through a pipe 23. The dust collection unit 27 is a filter type or a cyclone type dust collection apparatus. The dust collection unit 27 separates microparticles from air flow. A collection blower 28 is installed in the downstream of the dust collection unit 27. The collection blower 28 functions as a dust collection suction unit that sucks air from the dust collection unit 27. Air discharged from the collection blower 28 is discharged to the outside of the sheet manufacturing apparatus 100 through a pipe 29.

In this configuration, air is sucked from the suction unit 48 through the dust collection unit 27 by the collection blower 28. In the suction unit 48, microparticles passing through the meshes of the net of the mesh belt 46 are sucked along with air and sent to the dust collection unit 27 through the pipe 23. The dust collection unit 27 separates the microparticles that have passed through the mesh belt 46 from the air flow and accumulates the microparticles.

Therefore, fibers obtained by eliminating the matter to be eliminated from the first selected matter are deposited and the first web W1 is formed on the mesh belt 46. The collection blower 28 performs suction, so that formation of the first web W1 on the mesh belt 46 is promoted and the matter to be eliminated is quickly eliminated.

The humidifying unit 204 supplies humidified air to a space including the drum unit 41. The humidified air humidifies the first selected matter inside the selection unit 40. Thereby, adhesion of the first selected matter to the mesh belt 46 by an electrostatic force is weakened, so that the first selected matter can be easily peeled off from the mesh belt 46. Further, it is possible to prevent the first selected matter from being adhered to the rotating body 49 and an inner wall of the housing portion 43 by an electrostatic force. Further, the matter to be eliminated can be efficiently sucked by the suction unit 48.

A configuration which selects and separates the first selected matter and the second selected matter in the sheet manufacturing apparatus 100 is not limited to the selection unit 40 including the drum unit 41. For example, it is possible to employ a configuration where a classifier classifies the fibrillated matter subjected to the fibrillation processing in the fibrillating unit 20. As the classifier, for example, it is possible to use a cyclone classifier, an elbow-jet classifier, and an eddy classifier. When these classifiers are used, it is possible to select and separate the first selected matter and the second selected matter. Further, by the above classifiers, it is possible to realize a configuration that separates and eliminates the matter to be eliminated including fibrillated matter whose size is relatively small or whose density is low (resin particles, color materials, additive agents, and the like). For example, a configuration may be employed where a classifier eliminates microparticles included in the first selected matter from the first selected matter. In this case, a configuration can be employed where the second selected matter is returned to, for example, the fibrillating unit 20, the matter to be eliminated is collected by the dust collection unit 27, and the first selected matter except for the matter to be eliminated is sent to a pipe 54.

In a transport path of the mesh belt 46, air containing mist is supplied to the downstream side of the selection unit 40 by the humidifying unit 210. The mist that is microparticles of water generated by the humidifying unit 210 falls toward the first web W1 and supplies moisture to the first web W1. Thereby, an amount of moisture included in the first web W1 is adjusted, so that it is possible to suppress adsorption of fibers to the mesh belt 46 due to static electricity.

The sheet manufacturing apparatus 100 includes the rotating body 49 that cuts the first web W1 deposited on the mesh belt 46. The first web W1 is peeled off from the mesh belt 46 and cut off by the rotating body 49 at a position where the mesh belt 46 is folded back by the rollers 47.

The first web W1 is a soft material where fibers are deposited to form a web shape. The rotating body 49 loosens the fibers of the first web W1 and processes the fibers into a state where resin can be easily mixed into the fibers in the mixing unit 50 described later.

A configuration of the rotating body 49 is optional. However, in the present embodiment, the rotating body 49 may have a rotary vane shape that has a plate-shaped vane and rotates. The rotating body 49 is arranged at a position where the first web W1 that is peeling off from the mesh belt 46 is in contact with the vane. The vane hits and cuts the first web W1 that is peeling off from the mesh belt 46 and is being transported by the rotation of the rotating body 49 (for example, the rotation in a direction indicated by an arrow R in FIG. 1), and fractionated bodies P are generated.

It is preferable that the rotating body 49 is installed in a position where the vane of the rotating body 49 does not hit the mesh belt 46. For example, a gap between a tip of the vane of the rotating body 49 and the mesh belt 46 can be 0.05 mm or more and 0.5 mm or less. In this case, the first web W1 can be efficiently cut off without the mesh belt 46 being damaged by the rotating body 49.

The fractionated bodies P that are cut off by the rotating body 49 fall inside a pipe 7 and are transferred (transported) to the mixing unit 50 by an air flow flowing inside the pipe 7.

The humidifying unit 206 supplies humidified air to a space including the rotating body 49. Thereby, it is possible to suppress a phenomenon in which fibers are adsorbed to the inside of the pipe 7 and/or the vane of the rotating body 49 by static electricity. Further, highly humid air is supplied to the mixing unit 50 through the pipe 7, so that it is possible to suppress effects of static electricity in the mixing unit 50.

The mixing unit 50 includes an additive supply unit 52 that supplies an additive including resin, a pipe 54 which communicates with the pipe 7 and in which an air flow containing the fractionated bodies P flows, and a mixing blower 56.

As described above, the fractionated bodies P are the fibers obtained by eliminating the matter to be eliminated from the first selected matter that has passed through the selection unit 40. The mixing unit 50 mixes an additive including resin into fibers constituting the fractionated bodies P.

In the mixing unit 50, an air flow is generated by the mixing blower 56, and the fractionated bodies P and the additive are transported, while they are being mixed, in the pipe 54. The fractionated body P is untangled to become smaller fibers while the fractionated body P is flown inside the pipe 7 and the pipe 54.

The additive supply unit 52 (resin storage unit) is connected to an additive cartridge (not shown in the drawings) that accumulates additive, and supplies the additive inside the additive cartridge to the pipe 54. The additive cartridge may be configured to be attachable/detachable to/from the additive supply unit 52. A configuration to replenish additive into the additive cartridge may be included. The additive supply unit 52 once stores an additive composed of fine powders or microparticles inside the additive cartridge. The additive supply unit 52 has a discharge unit 52*a* (resin supply unit) that sends the once stored additive to the pipe 54.

The discharge unit 52*a* includes a feeder (not shown in the drawings) that sends the additive stored in the additive supply unit 52 to the pipe 54 and a shutter (not shown in the drawings) that opens and closes a pipe line that connects the feeder and the pipe 54. When the shutter is closed, a pipe line or an opening that connects the discharge unit 52*a* and the pipe 54 is closed, so that the supply of the additive from the additive supply unit 52 to the pipe 54 is stopped.

When the feeder of the discharge unit 52*a* does not operate, the additive is not supplied from the discharge unit 52*a* to the pipe 54. However, when a negative pressure is generated in the pipe 54, the additive may flow to the pipe 54 even when the feeder of the discharge unit 52*a* stops. Such a flow of the additive can be reliably shut off by closing the discharge unit 52*a*.

The additive supplied by the additive supply unit 52 include resin for binding a plurality of fibers together. The resin included in the additive is a thermoplastic resin and/or a thermosetting resin. For example, the resin is AS resin, ABS resin, polypropylene, polyethylene, polyvinyl chloride, polystyrene, acrylic resin, polyester resin, polyethylene terephthalate, polyphenylene ether, polybutylene terephthalate, nylon, polyamide, polycarbonate, polyacetal, polyphenylene sulfide, polyetheretherketone, and the like. These resins may be used alone or may be appropriately mixed together. In other words, the additive may include a single substance or may be a mixture, and each additive may include a plurality of types of particles, each of which is composed of a single or a plurality of substances. The additive may have a fibrous form or a powder form.

The resin included in the additive is melted by heating and binds a plurality of fibers together. Therefore, when resin and fibers are mixed and the resin is not heated to a temperature at which the resin melts, the fibers are not bound together.

The additive supplied by the additive supply unit 52 may include a coloring agent for coloring fibers according to a type of sheet to be manufactured, an aggregation inhibitor for inhibiting aggregation of fibers and aggregation of resins, and a flame retardant that makes fibers and the like difficult to burn, in addition to the resin that binds fibers together. An additive that does not contain a coloring agent may be colorless, may have a watery color that can be regarded as almost colorless, or may be white.

The fractionated bodies P falling in the pipe 7 and the additive supplied by the additive supply unit 52 are sucked inside the pipe 54 by an air flow generated by the mixing blower 56, and pass through inside the mixing blower 56. The fibers that constitute the fractionated bodies P and the additive are mixed by the air flow generated by the mixing blower 56 and/or an action of a rotating unit such as a vane included in the mixing blower 56, and the mixture (mixture of the first selected matter and the additive) is transferred to the depositing unit 60 through the pipe 54.

A mechanism for mixing the first selected matter and the additive is not particularly limited, and may be a mechanism that agitates the first selected matter and the additive by a vane rotating at high speed, or a mechanism such as a V type mixer that uses rotation of a container. These mechanisms may be installed in front of or behind the mixing blower 56.

The depositing unit 60 deposits the fibrillated matter that is fibrillated by the fibrillating unit 20. More specifically, the depositing unit 60 introduces the mixture that has passed through the mixing unit 50 from an introduction port 62, untangles a tangled fibrillated matter (fibers), and causes the fibrillated matter to fall while dispersing the fibrillated matter in the air. Further, when the resin of the additive supplied from the additive supply unit 52 is fibrous, the depositing unit 60 untangles tangled resin. Thereby, the depositing unit 60 can evenly deposit the mixture on the second web forming unit 70.

The depositing unit 60 has a drum unit 61 and a housing portion (cover portion) 63 that houses the drum unit 61. The drum unit 61 is a cylindrical sieve rotationally driven by a motor. The drum unit 61 has a net (filter, screen) and functions as a sieve. By meshes of the net, the drum unit 61 causes fibers and particles that are smaller than the mesh (opening) of the net to pass through and causes them to fall from the drum unit 61. A configuration of the drum unit 61 is the same as that of the drum unit 41.

The "sieve" of the drum unit 61 need not have a function to select a specific object. In other words, the "sieve" used as the drum unit 61 means a unit that includes a net, and the drum unit 61 may cause all the mixtures introduced to the drum unit 61 to fall.

The second web forming unit 70 is arranged below the drum unit 61. The second web forming unit 70 is deposited with passing objects that have passed through the depositing unit 60 and forms a second web W2. The second web forming unit 70 has, for example, a mesh belt 72, a rollers 74, and a suction mechanism 76.

The mesh belt 72 is an endless-shaped belt. The mesh belt 72 is suspended by a plurality of rollers 74 and transported in a direction indicated by an arrow shown in FIG. 1 by movement of the rollers 74. The mesh belt 72 is made of, for example, metal, resin, cloth, nonwoven fabric, or the like. A surface of the mesh belt 72 is formed of a net where openings of a predetermined size are arranged. In the fibers and particles falling from the drum unit 61, microparticles having a size that can pass through the meshes of the net fall below the mesh belt 72 and fibers having a size that cannot pass through the meshes of the net are deposited on the mesh belt 72 and transported in the arrow direction along with the mesh belt 72. The mesh belt 72 moves at a constant velocity V2 during a normal operation in which the sheet S is manufactured. Here, "during a normal operation" is the same as described above.

The size of the meshes of the net of the mesh belt 72 is very small, and the size can be a size where most of fibers and particles falling from the drum unit 61 do not pass through.

The suction mechanism 76 is provided below the mesh belt 72 (on a side opposite to the depositing unit 60). The suction mechanism 76 includes a suction blower 77 and can generate a downward air flow (air flow from the depositing unit 60 to the mesh belt 72) in the suction mechanism 76 by a suction force of the suction blower 77.

The mixture dispersed in the air by the depositing unit 60 is sucked on the mesh belt 72 by the suction mechanism 76. Thereby, formation of the second web W2 on the mesh belt 72 is promoted, and a discharge speed from the depositing unit 60 can be increased. Further, it is possible to form a down flow in a falling path of the mixture by the suction mechanism 76, and it is possible to prevent the fibrillated matter and the additive from being tangled together while falling.

The suction blower 77 (deposition suction unit) may discharge air sucked from the suction mechanism 76 to the outside of the sheet manufacturing apparatus 100 through a collection filter (not shown in the drawings). Alternatively, the air sucked by the suction blower 77 may be sent to the dust collection unit 27 and the matter to be eliminated included in the air sucked by the suction mechanism 76 may be collected.

The humidifying unit 208 supplies humidified air to a space including the drum unit 61. The inside of the depositing unit 60 can be humidified by the humidified air, so that it is possible to suppress adhesion of fibers and particles to the housing portion 63 due to an electrostatic force, cause the fibers and particles to quickly fall to the mesh belt 72, and form the second web W2 having a preferable shape.

As described above, the mixture passes through the depositing unit 60 and the second web forming unit 70 (a web forming step), so that a soft and fluffy second web W2 containing a lot of air is formed. The second web W2 deposited on the mesh belt 72 is transported to the sheet forming unit 80.

In a transport path of the mesh belt 72, air containing mist is supplied to the downstream side of the depositing unit 60 by the humidifying unit 212. Thereby, the mist generated by the humidifying unit 212 is supplied to the second web W2 and an amount of moisture included in the second web W2 is adjusted. Thereby, it is possible to suppress adsorption of fibers to the mesh belt 72 due to static electricity.

The sheet manufacturing apparatus 100 is provided with the transportation unit 79 that transports the second web W2 on the mesh belt 72 to the sheet forming unit 80. The transportation unit 79 has, for example, a mesh belt 79*a*, rollers 79*b*, and a suction mechanism 79*c*.

The suction mechanism 79*c* includes a blower (not shown in the drawings) and generates an upward air flow to the mesh belt 79*a* by a suction force of the blower. The air flow sucks the second web W2, and the second web W2 is separated from the mesh belt 72 and adsorbed to the mesh belt 79*a*. The mesh belt 79*a* is moved by rotation of the rollers 79*b* and transports the second web W2 to the sheet forming unit 80. A moving velocity of the mesh belt 72 and a moving velocity of the mesh belt 79*a* are, for example, the same.

In this way, the transportation unit 79 peels off the second web W2, which is formed on the mesh belt 72, from the mesh belt 72 and transports the second web W2.

The sheet forming unit 80 forms the sheet S from a deposited material deposited by the depositing unit 60. More specifically, the sheet forming unit 80 forms the sheet S by pressurizing and heating the second web W2 (deposited material) which is deposited on the mesh belt 72 and transported by the transportation unit 79. The sheet forming unit 80 binds together a plurality of fibers in the mixture through the additive (resin) by applying heat to fibers of the fibrillated matter and the additive included in the second web W2.

The sheet forming unit 80 includes a pressurizing unit 82 that pressurizes the second web W2 and a heating unit 84 that heats the second web W2 pressurized by the pressurizing unit 82.

The pressurizing unit 82 is configured of a pair of calendar rollers 85 and pressurizes the second web W2 by nipping the second web W2 by a predetermined nip pressure. The second web W2 is pressurized, so that the thickness of the second web W2 decreases and the density of the second web W2 increases. One of the pair of calendar rollers 85 is a driving roller driven by a motor (not shown in the drawings), and the other is a driven roller. The calendar rollers 85 are rotated by a driving force of the motor and transport the second web W2, whose density is increased by the pressurization, toward the heating unit 84.

The heating unit 84 can be configured by using, for example, a heating roller (heater roller), a heat press-molding machine, a hot plate, a hot air blower, an infrared ray heater, and a flash fixing device. In the present embodiment, the heating unit 84 includes a pair of heating rollers 86. The heating rollers 86 are heated to a temperature set in advance by a heater installed inside or outside the heating rollers 86. The heating rollers 86 pinch the second web W2 pressurized by the calendar rollers 85 and applies heat to the second web W2 to form the sheet S.

One of the pair of heating rollers 86 is a driving roller driven by a motor (not shown in the drawings), and the other is a driven roller. The heating rollers 86 are rotated by a driving force of the motor and transport the heated sheet S toward the cutting unit 90.

In this way, the second web W2 formed in the depositing unit 60 is pressurized and heated in the sheet forming unit 80 and becomes the sheet S.

The number of the calendar rollers 85 included in the pressurizing unit 82 and the number of the heating rollers 86 included in the heating unit 84 are not particularly limited.

The cutting unit 90 cuts the sheet S formed by the sheet forming unit 80. In the present embodiment, the cutting unit 90 has a first cutting unit 92 that cuts the sheet S in a direction crossing a transportation direction of the sheet S and a second cutting unit 94 that cuts the sheet S in a direction in parallel with the transportation direction. The second cutting unit 94 cuts, for example, the sheet S that has passed through the first cutting unit 92.

Thereby, a single sheet S having a predetermined size is formed. The cut single sheet S is discharged to a discharge unit 96. The discharge unit 96 includes a tray or a stacker on which the sheet S having the predetermined size is placed.

In the above configuration, the humidifying units 202, 204, 206, and 208 may be configured by one vaporizing type humidifier. In this case, it may be configured so that humidified air generated by the one humidifier is branched and supplied to the rough-crushing unit 12, the housing portion 43, the pipe 7, and the housing portion 63. This configuration can be easily realized by installing a duct (not shown in the drawings) that branches and supplies the humidified air. Alternatively, it is possible to configure the humidifying units 202, 204, 206, and 208 by two or three vaporizing type humidifiers.

Further, in the above configuration, the humidifying units 210 and 212 may be configured by one ultrasonic type humidifier. For example, it may be configured so that air containing mist generated by the one humidifier is branched and supplied to the humidifying unit 210 and the humidifying units 212.

In the above configuration, first, the rough-crushing unit 12 roughly crushes raw material, and then the sheet S is manufactured from the roughly crushed raw material. However, the sheet S may be manufactured by, for example, using fibers as raw material.

For example, it may be configured so that fibers equivalent to the fibrillated matter subjected to the fibrillation processing in the fibrillating unit 20 can be charged into the drum unit 41 as raw material. Further, it may be configured so that fibers equivalent to the first selected matter separated from the fibrillated matter can be charged into the pipe 54 as raw material. In this case, the sheet S can be manufactured by supplying fibers obtained by processing waste paper, pulp, or the like to the sheet manufacturing apparatus 100.

2. Granularity of Sheet Surface

In the present specification, a granularity of a sheet surface indicates an RMS granularity (root mean square) of a sheet surface. The RMS granularity is a granularity obtained by statistical probability and is an index for objectively indicating the granularity. Localization of coloring material particles and dot shapes of the coloring material particles are often specially random, and when they are seen by the naked eye, roughness impression (roughness feeling) is given. Such roughness is generally called granularity. A subjective evaluation value of the granularity is called graininess, and an objective evaluation value of the granularity is called granularity.

The RMS granularity is the standard deviation of the distribution of density $D_i$ and represented by a symbol the a. A measurement condition of the RMS granularity is generally specified in ANSI PH-2.40-1985. However, in the present embodiment, the RMS granularity is calculated by the following formula on the basis of an optical density of each dot read from a target surface of a sheet by a scanner with resolution of 1200 dpi. In the following formula, N is the number of data (the number of dots), $D_i$ is a density value of each dot, and $D_{ave}$ is an average value of density values.

$$\sigma = \sqrt{\frac{\sum_{i=1}^{n} (D_i - D_{ave})^2}{N-1}} \quad \text{[Expression 1]}$$

The above formula is formally a standard deviation formula itself and the RMS granularity (σ) has no unit. The standard deviation indicates how much a value varies with respect to an average value, and means that 68% of data is included in a range of the average value±1σ (σ=RMS). The greater the value of the RMS granularity (σ), the grater the variation, so that a subjective granularity increases and the roughness feeling increases.

In the sheet manufacturing apparatus of the present embodiment, when the additive includes resin that binds fibers together and also includes a coloring material, one of factors that change the granularity of a surface of the sheet S to be manufactured is dispersibility (adhesion distribution) of additive in a web. Further, in the sheet manufacturing apparatus of the present embodiment, when the raw material is waste paper including a color material such as toner, one of factors that change the granularity of the surface of the sheet S to be manufactured is a degree of crushing of a color material such as toner and dispersibility of the color material in the second web W2.

The resin and fibers included in the additive are attached together by electrostatic force when the second web W2 is formed in the depositing unit 60. However, when the resin (additive particles) is not arranged adjacent to fibers, the resin is easily desorbed from the fibers when an external force is applied. Therefore, it is possible to adjust the dispersibility of additive and toner (both are collectively referred to as color powder) in the second web W2 by controlling particle diameters of the color powder, the dispersibility of the color powder in the second web W2, the magnitude of an external force applied to the second web W2, and the like, so that it is possible to adjust the granularity of the surface of the sheet S to be finally manufactured.

A typical raw material including a color material such as toner is waste paper where white paper is printed with a color material such as ink, toner, or the like. In reproduction of white paper, waste paper having little residue of color material and having higher whiteness is preferred. However, even after a deinking process (a process performed by the selection unit 40 in the example described above), a color material component may remain. On the other hand, even when the degree of whiteness is low, there may be no problem if, as in a newspaper, the dispersibility of color material is extremely high and characters can be read without problem. Further, there may be a case where paper with high granularity is preferred as a name card, a letter paper, and a book spine cover of bookbinding instead of printing paper, as design and texture of the paper. It is possible to adjust texture of white paper to a desired granularity by controlling the dispersibility of remaining color material and the dispersibility of additive (binding resin) containing no color pigment and additive (binding resin) containing a white pigment.

3. Function of Sheet Manufacturing Apparatus

Figure 2:
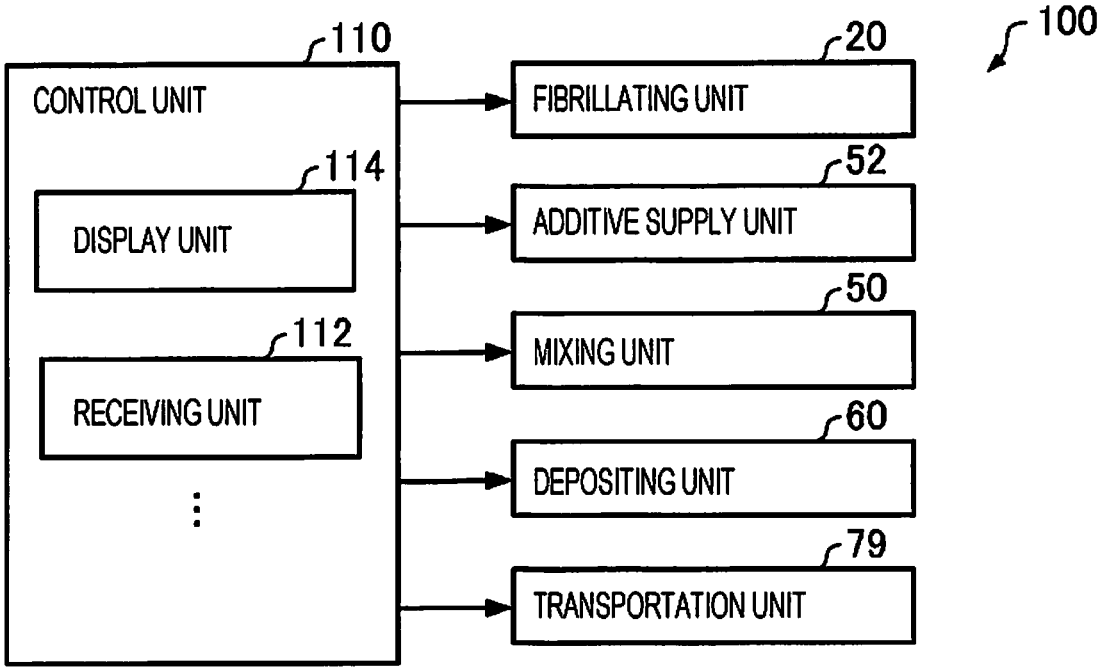
FIG. 2 is a functional block diagram of the sheet manufacturing apparatus.

FIG. 2 shows a functional block diagram of the sheet manufacturing apparatus 100. The sheet manufacturing apparatus 100 includes the control unit 110. The control unit 110 includes a receiving unit 112 and a display unit 114.

The receiving unit 112 (operation unit) is a device for receiving an input from s user. The receiving unit 112 outputs input information to the control unit 110. A function of the receiving unit 112 can be realized by input devices such as a keyboard, a mouse, a button, and a touch panel. The receiving unit 112 is realized by an interface where instruction information from an external apparatus such as a computer is inputted. The receiving unit 112 receives a setting (input) specifying, at least, a form of raw material (types such as printed wastepaper and pulp) and the roughness feeling (granularity) of the sheet S to be manufactured by the sheet manufacturing apparatus 100.

The display unit 114 (an example of an output unit) outputs an image generated by the control unit 110. The display unit 114 can be realized by a display such as LCD or CRT, a touch panel, or the like. When a touch panel is used, the display unit 114 may be integrated with the receiving unit 112.

The control unit 110 controls the fibrillating unit 20, the additive supply unit 52, the mixing unit 50, the depositing unit 60, the transportation unit 79, and the like of the sheet manufacturing apparatus 100 on the basis of the input information (the setting) and a program. A function of the control unit 110 can be realized by hardware such as a processor (CPU) and a storage unit (ROM, RAM) and a program.

The control unit 110 generates a control signal based on the information inputted from the receiving unit 112 and controls operations (rotation velocity and the like of a rotating body included in each unit) of the fibrillating unit 20, the additive supply unit 52, the mixing unit 50, the depositing unit 60, and the transportation unit 79. The control unit 110 may control an operating rate of each unit and control the operating rate. The operating rate may simply be an operating time of each unit. In this case, the control unit 110 counts the operating time. The operating rate may also be a value based on the number of rotations (the number of rotating times), a rotation velocity, a driving signal (the number of driving pulses) of a motor, or the like of a rotating body (screw, drum, blower, or the like) included in each unit.

The control unit 110 may have a storage unit (not shown in the drawings). The storage unit may store a table that associates a state of each component controlled by the control unit 110 with the roughness feeling (granularity) of the sheet S to be manufactured. Further, the storage unit of the control unit 110 may store a table that associates a type of toner or the like when printed waste paper is used as a raw material with a state of each component controlled by the control unit 110. The control unit 110 may control each component by referring to such a table.

4. Control of Fibrillating Unit, Additive Supply Unit, Mixing Unit, Depositing Unit, and Transportation Unit In the control of the sheet manufacturing apparatus of the present embodiment, it is possible to change the granularity (roughness feeling) of the surface of the sheet S to be manufactured by changing at least one of the fibrillating unit 20, the additive supply unit 52, the mixing unit 50, the depositing unit 60, and the transportation unit 79. Here, specific control of each of the fibrillating unit 20, the additive supply unit 52, the mixing unit 50, the depositing unit 60, and the transportation unit 79 will be sequentially described. The sheet manufacturing apparatus 100 of the present embodiment has the transportation unit 79. However, the transportation unit 79 is not an essential component and is provided as needed. Therefore, when the sheet manufacturing apparatus does not have the transportation unit 79, the control of the sheet manufacturing apparatus of the present embodiment can change the granularity (roughness feeling) of the surface of the sheet S to be manufactured by changing at least one of the fibrillating unit 20, the additive supply unit 52, the mixing unit 50, and the depositing unit 60.

4.1. Fibrillating Unit

The fibrillating unit 20 performs fibrillation processing on the raw material (roughly crushed pieces) cut by the rough-crushing unit 12 and generates a fibrillated matter. In the present embodiment, the fibrillating unit 20 includes a rotor (not shown in the drawings) rotating at high speed and a liner (not shown in the drawings) located on an outer circumference of the rotor. The rotor is a rotating unit (In the present specification, the rotating unit located in the fibrillating unit 20 may be referred to as a "second rotating unit". A rotating unit located in the mixing unit 50 described later may be referred to as a "first rotating unit") and a rotation velocity of the rotor is controlled by the control unit 110.

When the raw material is waste paper containing color material such as toner, the fibrillated matter fibrillated by the fibrillating unit 20 contains fibrillated fibers, toner, and the like. The toner and the like receive an action where the toner and the like are crushed and peeled off from fibers by the fibrillating unit 20 or are crushed by the fibrillating unit 20 in a state where the toner and the like are attached to fibers.

The degree (strength) of the action can be changed by the rotation velocity of the second rotating unit.

Therefore, when the control unit 110 performs control to increase the rotation velocity of the second rotating unit, the particle diameter of colored particles such as toner passing through the fibrillating unit 20 tends to be small. Thereby, the granularity of the surface of the sheet S caused by the colored particles included in the raw material becomes small, that is, the roughness feeling tends to be suppressed. On the other hand, when the control unit 110 performs control to decrease the rotation velocity of the second rotating unit, the particle diameter of colored particles such as toner passing through the fibrillating unit 20 tends to be large and the granularity of the surface of the sheet S caused by the colored particles included in the raw material becomes large, that is, the roughness feeling tends to increase.

When the rotation velocity of the second rotating unit of the fibrillating unit 20 is increased, the sizes of the fibrillated matter and the colored particles tend to be small, so that the amount of the matter to be eliminated that is collected by the dust collection unit 27 may be large in the subsequent selection unit 40. Therefore, an upper limit of the rotation velocity of the second rotating unit of the fibrillating unit 20 is appropriately set considering a balance between the amount of the matter to be eliminated in the selection unit 40 and the granularity of the surface of the sheet S to be obtained.

4.2. Additive Supply Unit

The additive supply unit 52 supplies an additive to the pipe 54. The additive supply unit 52 has the discharge unit 52*a* (resin supply unit) that sends the additive to the pipe 54. The discharge unit 52*a* includes a feeder (powder supply device) that feeds the additive stored in the additive supply unit 52 to the pipe 54. The feeder can employ an ordinary structure without limitation. However, it is preferable that the feeder has a structure that can freely change a supply amount of the additive to the pipe 54 according to a signal from the control unit 110. Examples of such a feeder include a screw type feeder, a plate (disc) type feeder, and a vibration type feeder. Further, even a feeder including a shutter or the like can be employed if the feeder has a structure that can change an opening degree of the shutter according to a signal from the control unit 110.

It is possible to freely change the supply amount of the additive per unit time according to a signal from the control unit 110 by employing these feeders for the additive supply unit 52. As a specific example, when the screw type feeder is employed for the additive supply unit 52, the control unit 110 can change the supply amount of the additive supplied to the pipe 54 per unit time by controlling the number of rotations of the screw.

When the control unit 110 performs control so as to increase the supply amount of the additive from the additive supply unit 52 per unit time, a contained amount of the additive in the second web W2 and the sheet S tends to increase. On the other hand, when the control unit 110 performs control so as to decrease the supply amount of the additive from the additive supply unit 52 per unit time, the contained amount of the additive in the second web W2 and the sheet S tends to decrease.

The control unit 110 can change the granularity of the surface of the sheet S when the additive includes a coloring material by varying the supply amount of the additive from the additive supply unit 52 per unit time. A variation aspect of the supply amount of the additive from the additive supply unit 52 per unit time is not particularly limited. However, it is possible to illustrate an aspect in which, when the supply amount of the additive from the additive supply unit 52 per unit time is graphed with respect to time axis, the graph has a shape of sine wave, rectangular wave, triangular wave, or an arbitrary combination of these waves.

A variation width of the supply amount of the additive per unit time (corresponding to an amplitude when the graph is a sine wave (sine curve)) is 80 to 120 and preferably 85 to 115, that is, an average value (100%)±20% and preferably about ±15% when a value during no variation (median value) is 100.

A variation period of the supply amount of the additive per unit time (corresponding to a period when the graph is a sine wave (sine curve)) is 1 to 20 seconds, preferably 2 to 15 seconds, and more preferably 3 to 10 seconds, that is, a variation frequency of the supply amount of the additive per unit time is 0.05 to 1 Hz, preferably 0.067 to 0.5 Hz, and more preferably 0.1 to 0.333 Hz.

When the additive contains a color material, if varying the supply amount of the additive supplied from the additive supply unit 52 per unit time, it is possible to change the granularity (roughness feeling) of the surface of the sheet S depending on the width and the period of the variation. In the sheet manufacturing apparatus 100, the additive supplied from the additive supply unit 52 becomes the sheet S through, at least, the mixing unit 50 and the depositing unit 60, so that the variation of the supply amount of the additive supplied from the additive supply unit 52 per unit time does not necessarily simply correlate with the variation of the granularity of the surface of the sheet S. Therefore, making the variation of the supply amount of the additive supplied from the additive supply unit 52 per unit time is one means for changing the roughness feeling, and it is preferable to adjust the width and the period of the variation by combining adjustment of operation conditions of the other components in order to obtain the granularity (roughness feeling) of a surface of a given sheet S.

4.3. Mixing Unit

The mixing unit 50 includes the mixing blower 56 that mixes and transports the additive and the fractionated bodies P. The fractionated bodies P falling in the pipe 7 and the additive supplied by the additive supply unit 52 are sucked inside the pipe 54 by an air flow generated by the mixing blower 56, and pass through inside the mixing blower 56. The fibers that constitute the fractionated bodies P and the additive are mixed by the air flow generated by the mixing blower 56 and/or an action of a rotating unit (first rotating unit) such as a vane included in the mixing blower 56, and the mixture (mixture of the first selected matter and the additive) is transferred to the depositing unit 60 through the pipe 54.

When the raw material is waste paper including a color material such as toner, the fractionated bodies P include fibrillated fibers, toner, and the like, so that when the control unit 110 performs control to increase the rotation velocity of the first rotating unit, the dispersibility of colored particles such as toner in the second web W2 is improved and the roughness feeling of the sheet S tends to be suppressed. On the other hand, when the control unit 110 performs control to decrease the rotation velocity of the first rotating unit in this case, the dispersion of colored particles such as toner in the second web W2 is suppressed and the roughness feeling of the sheet S tends to increase. Also in a case when the additive includes a coloring material, this tendency is the same for the dispersion of the additive and the roughness feeling in the second web W2 and the sheet S. Thus, the granularity of the surface of the sheet S can be changed by the rotation velocity of the first rotating unit.

4.4. Depositing Unit

The depositing unit 60 introduces the mixture that has passed through the mixing unit 50 from the introduction port 62, untangles a tangled fibrillated matter (fibers), and causes the fibrillated matter to fall while dispersing the fibrillated matter in the air. The depositing unit 60 has the drum unit 61 and the housing portion (cover portion) 63 that houses the drum unit 61. The drum unit 61 is a cylindrical sieve rotationally driven by a motor. The second web forming unit 70 is arranged below the drum unit 61. The second web forming unit 70 is deposited with passing objects that have passed through the depositing unit 60 and forms the second web W2.

The control unit 110 can control the rotation velocity of the drum unit 61. The mixture that has passed through the mixing unit 50 includes the fibers that constitute the fractionated bodies P and the additive. When the raw material includes a color material such as toner, the mixture includes the remaining color material (not eliminated in the selection unit 40).

Therefore, when the control unit 110 performs control to increase the rotation velocity of the drum unit 61, the dispersion of the mixture that is passing through the sieve of the drum unit 61 is intensified and the second web W2 where the color material is more uniformly arranged is formed, so that the roughness feeling of the sheet S tends to be suppressed. On the other hand, when the control unit 110 performs control to decrease the rotation velocity of the drum unit 61, the dispersion of the mixture that is passing through the sieve of the drum unit 61 is weakened and the second web W2 where the dispersion of the color material is unevenly arranged on a plane is formed, so that the roughness feeling of the sheet S tends to increase. Thus, the granularity of the surface of the sheet S can be changed by the rotation velocity of the drum unit 61.

4.5. Second Web Forming Unit

As described above, the second web forming unit 70 has the mesh belt 72, the rollers 74, and the suction mechanism 76. However, the second web forming unit 70 can be regarded as a part of the depositing unit 60 in a point that the second web W2 (deposited material) is formed on the mesh belt 72.

The surface (deposition surface) of the mesh belt 46 is formed of a net where openings of a predetermined size are arranged. The size of the meshes of the net of the mesh belt 72 is very small, and the size can be a size where most of fibers and particles falling from the drum unit 61 do not pass through. The suction mechanism 76 is provided below the mesh belt 72.

In the above example, the suction mechanism 76 generates an air flow in a direction substantially perpendicular to the deposition surface where the second web W2 (deposited material) is deposited. However, when considering the function of the suction mechanism 76, it can be understood that the direction of the air flow generated by the suction mechanism 76 may be a direction crossing the deposition surface where the second web W2 (deposited material) is deposited.

The suction mechanism 76 includes the suction blower 77 and can generate an air flow in a direction crossing the deposition surface, where the second web W2 (deposited material) is deposited, by the suction force of the suction blower 77. It can be said that the suction mechanism 76 is an air flow generation unit (first air flow generation unit).

The control unit 110 can control the suction force (rotation velocity of rotary vane) of the suction blower 77. Thereby, the control unit 110 can change a flow velocity of the air flow in a direction crossing the deposition surface where the second web W2 (deposited material) is deposited.

The deposited material (second web W2) includes fibers and the additive. When the raw material includes a color material such as toner, the deposited material also includes the color material. When an air flow flows in the deposited material in the thickness direction, relatively small-sized particles in the deposited material are easily moved along with the air flow. This tendency increases when the flow velocity of the air flow increases. The moving velocity of the fibers included in the deposited material is smaller than that of the particles of the additive and the like due to the elongated shape of the fibers. Among the particles of the additive and the like, particles attached to the fibers are more difficult to be moved by the air flow than isolated particles. Therefore, when the air flow passes through the deposited material, relatively small-sized particles move from an upper surface of the deposited material (second web W2) toward a lower surface of the deposited material, so that the number of particles located on the upper surface side decreases. On the other hand, on the lower surface side, relatively small-sized particles are desorbed, so that the number of particles located on the lower surface side decreases.

Therefore, when the control unit 110 performs control to increase the flow velocity of the air flow, the number of relatively small-sized particles located on the upper surface side and the lower surface side of the second web W2 further decreases. On the other hand, when the control unit 110 performs control to decrease the flow velocity of the air flow, the number of relatively small-sized particles located on the upper surface side and the lower surface side of the second web W2 further increases.

Therefore, when the relatively small-sized particles include a color material, if the control unit 110 increases the flow velocity of the air flow, the granularity (roughness feeling) of the surface of the sheet S tends to intensify, and if the control unit 110 decreases the flow velocity of the air flow, the granularity (roughness feeling) of the surface of the sheet S tends to weaken. Thus, it is possible to change the granularity of the surface of the sheet S by changing the flow velocity of the air flow in the direction crossing the deposition surface, where the second web W2 (deposited material) is deposited, by the control of the air flow generation unit of the depositing unit 60.

4.6. Transportation Unit By passing through the depositing unit 60 and the second web forming unit 70 (a web forming step), a soft and fluffy second web W2 containing a lot of air is formed. The sheet manufacturing apparatus 100 is provided with the transportation unit 79 that transports the second web W2 on the mesh belt 72 toward the sheet forming unit 80. The transportation unit 79 has, for example, the mesh belt 79*a*, the rollers 79*b*, and the suction mechanism 79*c*. The sheet manufacturing apparatus 100 of the present embodiment has the transportation unit 79. However, the transportation unit 79 is not an essential component and is provided as needed.

The suction mechanism 79*c* includes a blower (not shown in the drawings) and generates an upward air flow to the mesh belt 79*a* by a suction force of the blower. The air flow sucks the second web W2, and the second web W2 is separated from the mesh belt 72 and adsorbed to the mesh belt 79*a*.

In the above example, the suction mechanism 79*c* generates an air flow in a direction substantially perpendicular to the deposition surface where the second web W2 (deposited material) is deposited. However, when considering the function of the suction mechanism 79*c*, it can be understood that the direction of the air flow generated by the suction mechanism 79*c* may be a direction crossing the deposition surface where the second web W2 (deposited material) is deposited.

Further, in the above example, the suction mechanism 79*c* generates an air flow in a direction substantially perpendicular to an adsorption surface where the second web W2 (deposited material) is adsorbed (a surface (contact surface) of the mesh belt 79*a* to be in contact with the second web W2). However, when considering the function of the suction mechanism 79*c*, it can be understood that the direction of the air flow generated by the suction mechanism 79*c* may be a direction crossing the adsorption surface where the second web W2 (deposited material) is adsorbed.

The suction mechanism 79*c* includes a blower and can generate an air flow in a direction crossing the deposition surface, where the second web W2 (deposited material) is deposited, by a suction force of the blower. It can be said that the suction mechanism 79*c* is an air flow generation unit (second air flow generation unit).

The control unit 110 can control the suction force (rotation velocity of rotary vane) of the blower. Thereby, the control unit 110 can change a flow velocity of the air flow in a direction crossing the deposition surface where the second web W2 (deposited material) is deposited.

The deposited material (second web W2) includes fibers and the additive. When the raw material includes a color material such as toner, the deposited material also includes the color material. When an air flow flows in the deposited material in the thickness direction, relatively small-sized particles in the deposited material are easily moved along with the air flow. This tendency increases when the flow velocity of the air flow increases. The moving velocity of the fibers included in the deposited material is smaller than that of the particles of the additive and the like due to the elongated shape of the fibers. Among the particles of the additive and the like, particles attached to the fibers are more difficult to be moved by the air flow than isolated particles. Therefore, when the air flow passes through the deposited material, relatively small-sized particles move from the lower surface of the deposited material (second web W2) toward the upper surface of the deposited material, so that the number of particles located on the lower surface side decreases. On the other hand, on the upper surface side, relatively small-sized particles are desorbed, so that the number of particles located on the upper surface side decreases.

Therefore, when the control unit 110 performs control to increase the flow velocity of the air flow, the number of relatively small-sized particles located on the upper surface side and the lower surface side of the second web W2 further decreases. On the other hand, when the control unit 110 performs control to decrease the flow velocity of the air flow, the number of relatively small-sized particles located on the upper surface side and the lower surface side of the second web W2 further increases.

Therefore, when the relatively small-sized particles include a color material, if the control unit 110 increases the flow velocity of the air flow, the granularity (roughness feeling) of the surface of the sheet S tends to intensify, and if the control unit 110 decreases the flow velocity of the air flow, the granularity (roughness feeling) of the surface of the sheet S tends to weaken. Thus, it is possible to change the granularity of the surface of the sheet S by changing the flow velocity of the air flow in the direction crossing the deposition surface, where the second web W2 (deposited material) is deposited, by the control of the air flow generation unit of the transportation unit 79.

5. Receiving Unit

The sheet manufacturing apparatus 100 may have the receiving unit 112. The receiving unit 112 receives a setting of the granularity (roughness feeling) of the surface of the sheet S. The setting of the granularity (roughness feeling) of the surface of the sheet S can be set by a user. However, the granularity may be set by referring to a table or the like.

Figure 3:
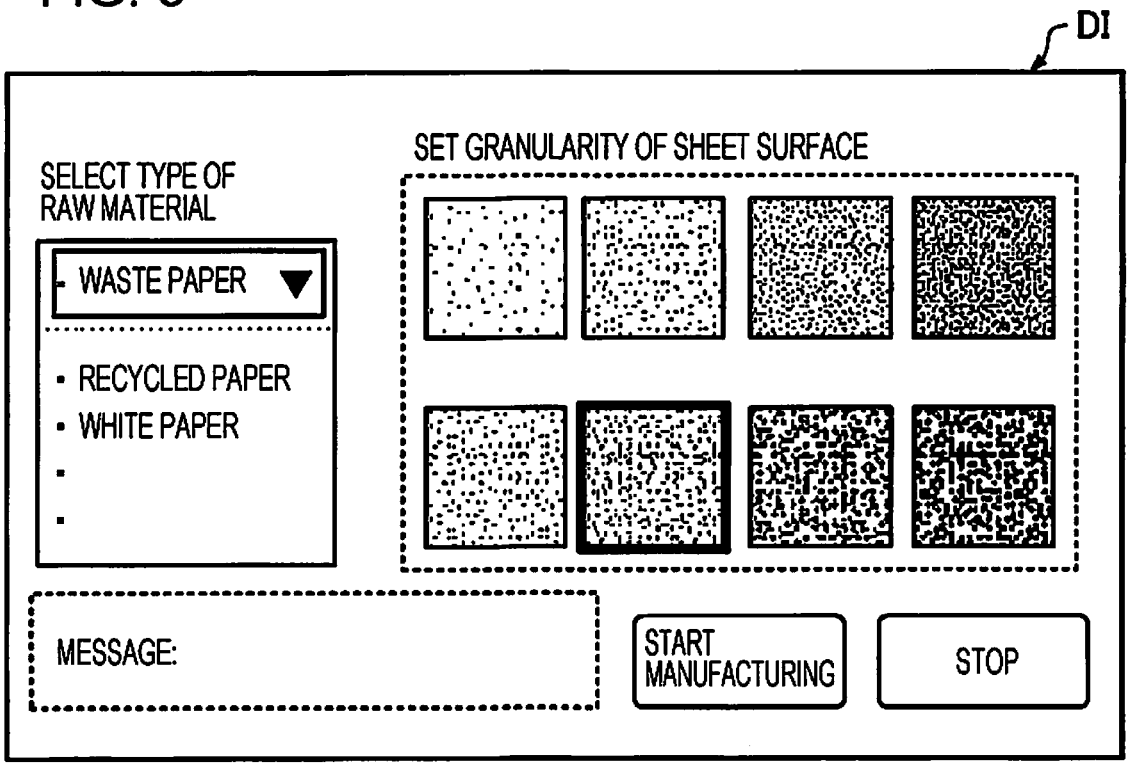
FIG. 3 is a diagram showing an example of a user interface.

FIG. 3 is a diagram showing an example of a display screen DI (user interface) displayed on the receiving unit 112 (display unit 114). In the example of FIG. 3, the display screen DI shows a menu for setting a selection of a type of a raw material (waste paper and the like) to be supplied to the sheet manufacturing apparatus 100 and a menu for setting the granularity (roughness feeling) of the surface of the sheet S to be manufactured. In the selection menu for setting the roughness feeling, a pattern diagram from which visual appearances of the sheet S to be manufactured can be imagined is displayed. The visual appearances in FIG. 3 are a pattern diagram sensuously understandable for a user and are different from the roughness feeling of the sheet S to be actually manufactured.

As shown in FIG. 3, the display screen DI may display various statuses of the sheet manufacturing apparatus 100, notification and alarm to the user, and the like as messages.

The user can perform input for selecting (specifying) the granularity (roughness feeling) of the surface of the sheet S to be manufactured by operating the selection menu by using the operation unit (receiving unit 112).

In the example shown in FIG. 3, the user can perform input for starting manufacturing of the sheet S by operating a start manufacturing button, and can perform input for stopping manufacturing of the sheet S by operating a stop button.

The example of FIG. 3 shows a state where the waste paper is selected as the type of raw material and the second leftmost button in the lower row is selected as the granularity of the surface of the sheet S from among eight options. In this example, sensuous options are shown in the setting screen of the roughness feeling. However, it can be designed so that, for example, values of the RMS granularity are displayed and the user selects one of the values.

6. Effects

According to the sheet manufacturing apparatus 100 of the present embodiment, it is possible to adjust the granularity of the surface of the sheet S (the roughness feeling in the appearance of the sheet S), and it is also possible to quickly generate a state in which the sheet S can be stably manufactured when manufacturing a sheet S with a desired roughness feeling. Further, it is possible to adjust the granularity of the surface of the sheet S by controlling at least one of the fibrillating unit 20, the additive supply unit 52, the mixing unit 50, the depositing unit 60, and the transportation unit 79, and it is possible to reduce the size of the apparatus by performing each process in a dry system. Therefore, when a condition of each process is changed, the change is quickly reflected to the sheet S (product) and a state in which the sheet having a given granularity is stably manufactured is easily achieved in a short time.

Further, after manufacturing a predetermined number of sheets having a specific roughness feeling, the sheet manufacturing apparatus 100 of the present embodiment can easily manufacture sheets having a different roughness feeling without changing the raw material and a mechanical configuration of the apparatus, and a transition time in this case can be short.

7. Sheet Manufacturing Method

A sheet manufacturing method has a fibrillating step of fibrillating a raw material including fibers in a gas and obtaining a fibrillated matter, an additive supplying step of supplying an additive to the fibrillated matter, a mixing step of mixing the fibrillated matter and the additive and obtaining a mixture, a depositing step of depositing the mixture and obtaining a deposited material, and a sheet forming step of forming a sheet by heating and pressurizing the deposited material deposited by a depositing unit. Then, a granularity of a sheet surface is changed by changing a state of a product of at least one of the fibrillating step, the additive supplying step, the mixing step, the depositing step, and a transporting step.

The fibrillating step can be performed by the fibrillating unit 20 described above, and by changing the rotation velocity of the second rotating unit, it is possible to change particle diameters of color material particles such as toner included in the fibrillated matter which is a product of the fibrillating step when printed waste paper is used as a raw material.

The additive supplying step can be performed by the additive supply unit 52 described above, and by changing the supply amount per unit time of the additive to be supplied, it is possible to change an amount or a ratio of color material particles such as toner included in the mixture of the additive and the fibrillated matter which is a product of the additive supplying step and/or the additive.

The mixing step can be performed by the mixing unit 50 described above, and by changing the rotation velocity of the first rotating unit, it is possible to change the dispersibility of color material particles such as toner included in the mixture which is a product of the mixing step and/or the additive.

The depositing step can be performed by the depositing unit 60 described above, and by changing the rotation velocity of the drum unit 61, it is possible to change the dispersibility of color material particles such as toner included in the deposited material (second web W2) which is a product of the mixing step and/or the additive.

In the depositing step, it is possible to change amounts of color material located on the upper surface side and the lower surface side of the second web W2 (deposited material) by changing the flow velocity of the air flow in the direction crossing the deposition surface where the second web W2 (deposited material) is deposited.

The sheet manufacturing method of the present embodiment may have a transporting step of transporting the deposited material deposited in the depositing step. In the transporting step, it is possible to change amounts of color material located on the upper surface side and the lower surface side of the second web W2 (deposited material) by changing the flow velocity of the air flow in the direction crossing the deposition surface where the second web W2 (deposited material) is deposited.

In the sheet manufacturing method of the present embodiment, it is possible to change the state of the product of at least one of the fibrillating step, the additive supplying step, the mixing step, the depositing step, and the transporting step in this way, and thereby the granularity of the surface of the sheet S can be changed.

8. Example and Comparative Example

Hereinafter, the present invention will be described in further detail with reference to examples and a comparative example. The invention can be variously modified without departing from the scope of the invention, and the invention is not limited at all by the examples described below.

Sheets of the examples and the comparative example were manufactured by the sheet manufacturing apparatus as shown in FIG. 1 by operating each component under conditions described in Table 1 below. A mass ratio of the additive to the fibers in a sheet of each example was 15 mass %. In the examples 1 to 5, an additive containing a cyan pigment was used as a color material, and in the examples 6 to 9, an additive containing a white pigment was used as a color material. While a mass ratio of the additive to the fibers in a sheet of the comparative example was 15 mass, in the additive, an additive containing a cyan pigment was 50 mass % and an additive containing no pigment was 50 mass %. As a raw material, N100 (PPC sheet) manufactured by Nippon paper industry Co., Ltd. was used. In the examples 1 to 5 and the comparative example, a paper that is not printed (unprinted paper) was used. In the examples 6 to 9, a paper (printed paper) that is printed by a laser printer LP-S9000 manufactured by Seiko Epson Corporation was used.

The RMS granularity is calculated by the formula described above on the basis of an optical density of each dot read from a surface of a sheet of each example by a scanner with resolution of 1200 dpi.

TABLE 1

| | Example | | | | | | | | | Comparative |
|---|---|---|---|---|---|---|---|---|---|---|
| Sheet manufacturing condition | 1 | 2 | 3 | 4 | 5 | 6 | 7 | 8 | 9 | Example 1 |
| Raw material<br>Type of additive | Unprinted paper<br>Containing cyan pigment | | | | | Printed paper<br>Containing white pigment | | | | Unprinted paper<br>Containing cyan pigment of 50 mass %<br>Containing white pigment of 50 mass % |
| Variation width of supply amount per unit time of additive supply unit | ±5% | ±15% | ±5% | ±5% | ±5% | ±5% | ±5% | ±5% | ±5% | ±5% |

TABLE 1-continued

| Sheet manufacturing condition | Example 1 | 2 | 3 | 4 | 5 | 6 | 7 | 8 | 9 | Comparative Example 1 |
|---|---|---|---|---|---|---|---|---|---|---|
| (based on average in 10 seconds) | | | | | | | | | | |
| Rotation velocity (rpm) of first rotating unit in mixing unit | 5000 | 5000 | 3000 | 5000 | 5000 | 3000 | 5000 | 3000 | 5000 | 5000 |
| Rotation velocity (rpm) of drum unit in depositing unit | 150 | 150 | 150 | 250 | 150 | 150 | 150 | 150 | 150 | 150 |
| Rotation velocity (rpm) of second rotating unit in fibrillating unit | 3000 | 3000 | 3000 | 3000 | 3000 | 2000 | 2000 | 3000 | 3000 | 3000 |
| Intensity of air flow of air flow generation unit of depositing unit and transportation unit | Normal | Normal | Normal | Normal | High | Normal | Normal | Normal | Normal | Normal |
| RMS granularity (−) | 0.022 | 0.045 | 0.068 | 0.05 | 0.055 | 0.078 | 0.058 | 0.029 | 0.016 | 0.018 |

The visual roughness feeling of the sheet of the example 1 is also small, and the RMS granularity is also small. On the other hand, as shown in Table 1, the roughness feeling of the sheets of the examples 2 to 5 is greater than that of the example 1, and the RMS granularity is also great.

In the example 2, pulsation is applied to a supply rate of the additive by changing the number of rotations of the screw of the additive supply unit 52 at every one second. As a result, variation of supply of the additive increases, mixability between fibers and resin (additive) decreases, and evenness of distribution of the resin decreases in the sheet, so that it is considered that the roughness feeling increases.

As in the example 3, when mixability of the mixing unit 50 is low, it is considered that electrostatic adhesion between the fibers and the resin weakens, so that it is estimated that the additive is easily moved in the second web W2 in the thickness direction and easily desorbed from the second web W2 by winds generated by the suction mechanisms of the depositing unit 60 and the transportation unit 79. As a result, the RMS granularity increases.

In the example 4, the number of rotations of the drum unit 61 is increased, so that it is considered that when a material is sieved, fibers and resin are easily separated and they are further separated by a rotating wind of the drum unit 61, so that the resin is partially desorbed. Thereby, it is considered that evenness of distribution of the additive is somewhat improved and the roughness feeling is decreased.

In the example 5, a wind velocity by the suction mechanisms (the first air flow generation unit and the second air flow generation unit) is increased, so that it is considered that an additive whose binding force with fibers close to a surface on a suction side is selectively desorbed from the fibers, and it is considered that thereby the RMS granularity of the surface on the suction side is increased. It is found that the RMS granularity on both sides of the sheet can be changed when the wind velocity in a step of suctioning from both sides of the second web W2 is increased in this way. It can also be understood that the RMS granularities on one surface and the other surface of the sheet can be differentiated from each other by differentiating suction conditions from both surfaces.

It is found that an existence ratio of local additives on a sheet surface can be changed by partially desorbing the additive from the fibers and the granularity of the surface of the sheet can be easily changed. In this way, texture can be changed for each usage of a colored paper by changing the roughness feeling of the colored paper.

In the examples 6 to 9, printed waste paper is used as a raw material, and effects of the particle diameters and the dispersibility of color material such as toner that is not separated and collected by the selection unit 40 and remains and the dispersibility of the additive on the RMS granularity of the sheet are studied.

The visual roughness feeling of the sheet of the example 9 is also small, and the RMS granularity is also small. On the other hand, as shown in Table 1, the roughness feeling of the sheets of the examples 6 to 8 is greater than that of the example 9, and the RMS granularity is also great.

In the example 6, the rotation velocity of the second rotating unit of the fibrillating unit 20 is decreased from normal 3000 rpm to 2000 rpm and a fibrillation state of fibers of raw material paper and a crushing state of the remaining toner are roughened. Further, the rotation velocity of the first rotating unit of the mixing unit 50 is decreased from normal 5000 rpm to 3000 rpm, so that a state is made where additive agents are more hardly dispersed. As a result, a sheet whose RMS granularity is 0.078 where the roughness feeling is the highest among the examples is obtained.

In the example 7, the rotation velocity of the second rotating unit of the fibrillating unit 20 is decreased from normal 3000 rpm to 2000 rpm and the fibrillation state of fibers of raw material paper and the crushing state of the remaining toner are roughened. In the example 8, the rotation velocity of the first rotating unit of the mixing unit 50 is decreased from normal 5000 rpm to 3000 rpm, so that a state is made where additive agents are more hardly dispersed. When viewing the examples 7 and 8, it is found that when a crushing degree by the fibrillating unit 20 is increased, the roughness feeling is suppressed, and when the dispersibility by the mixing unit 50 is increased, the roughness feeling is suppressed.

As compared with the examples described above, the sheet of the comparative example 1 has substantially the same RMS granularity as that of the example 1. That is, it is found that the granularity of the surface of the sheet to be manufactured does not change largely only by changing composition of the additive without changing operation conditions of each component of the sheet manufacturing apparatus.

In the present invention, some components may be omitted and the embodiments and the modified examples may be combined as long as the features and effects described in the present specification are maintained. The present invention is not limited to the embodiment described above, but can be variously modified. For example, the present invention includes substantially the same configuration as that described in the embodiment (for example, a configuration having the same functions, methods, and results, or a configuration having the same object and effects). Further, the present invention includes a configuration in which nonessential portions of the configuration described in the embodiment are replaced. Further, the present invention includes a configuration that achieves the same operational effects or can achieve the same object as those of the configuration described in the embodiment. Further, the present invention includes a configuration in which a known technique is added to the configuration described in the embodiment.

REFERENCE SIGNS LIST

2 PIPE
3 PIPE
7 PIPE
8 PIPE
9 CHUTE
10 SUPPLY UNIT
12 ROUGH-CRUSHING UNIT
14 ROUGH-CRUSHING BLADES
20 FIBRILLATING UNIT
22 INTRODUCTION PORT
23 PIPE
24 DISCHARGE PORT
26 FIBRILLATING UNIT BLOWER
27 DUST COLLECTION UNIT
28 COLLECTION BLOWER
29 PIPE
40 SELECTION UNIT
41 DRUM UNIT
42 INTRODUCTION PORT
43 HOUSING PORTION
44 DISCHARGE PORT
45 FIRST WEB FORMING UNIT
46 MESH BELT
47 ROLLER
48 SUCTION UNIT
49 ROTATING BODY
50 MIXING UNIT
52 ADDITIVE SUPPLY UNIT
52*a* DISCHARGE UNIT
54 PIPE
56 MIXING BLOWER
60 DEPOSITING UNIT
61 DRUM UNIT
62 INTRODUCTION PORT
63 HOUSING PORTION
70 SECOND WEB FORMING UNIT
72 MESH BELT
74 ROLLER
76 SUCTION MECHANISM
77 SUCTION BLOWER
79 TRANSPORTATION UNIT
79*a* MESH BELT
79*b* ROLLER
79*c* SUCTION MECHANISM
80 SHEET FORMING UNIT
82 PRESSURIZING UNIT
84 HEATING UNIT
85 CALENDAR ROLLER
86 HEATING ROLLER
90 CUTTING UNIT
92 FIRST CUTTING UNIT
94 SECOND CUTTING UNIT
96 DISCHARGE UNIT
100 SHEET MANUFACTURING APPARATUS
110 CONTROL UNIT
112 RECEIVING UNIT
114 DISPLAY UNIT
202 HUMIDIFYING UNIT
204 HUMIDIFYING UNIT
206 HUMIDIFYING UNIT
208 HUMIDIFYING UNIT
210 HUMIDIFYING UNIT
212 HUMIDIFYING UNIT
W1 FIRST WEB
P FRACTIONATED BODY
V1 VELOCITY
V2 VELOCITY
W2 SECOND WEB
S SHEET
DI DISPLAY SCREEN

The invention claimed is:

1. A sheet manufacturing apparatus comprising:

a fibrillating unit that includes a rotor and fibrillates a raw material including fibers in a gas;

an additive supply unit that includes a feeder and supplies an additive;

a mixing unit including a blower with a rotating unit disposed downstream relative to the additive supply unit in a transport direction of a fibrillated matter fibrillated by the fibrillating unit, the rotating unit mixing the fibrillated matter and the additive supplied by the additive supply unit;

a depositing unit that is disposed downstream relative to the rotating unit of the blower of the mixing unit in the transport direction of the fibrillated matter and deposits a mixture mixed by the mixing unit;

a web forming unit including a first mesh belt that transports a deposited material deposited by the depositing unit and including a suction mechanism that sucks the deposited material to the first mesh belt; and a controller configured to control a rotation velocity of the rotating unit of the blower of the mixing unit, and further controls at least one of a supply amount per unit time from the additive supply unit and a suction force of the suction mechanism, to change granularity of a surface of the sheet, wherein the suction mechanism has a first air flow generation unit that generates an air flow in a direction crossing a deposition surface where the deposited material is deposited, and the controller is configured to change a flow velocity of the air flow generated by the first air flow generation unit.

2. The sheet manufacturing apparatus according to claim 1, further comprising:

a receiving unit that receives a setting of the granularity of the surface of the sheet, wherein the controller is configured to control the number of rotations of the rotating unit of the mixing unit, and at least one of the supply amount per unit time from the additive supply unit and the suction force of the suction mechanism, based on the setting received by the receiving unit.

3. The sheet manufacturing apparatus according to claim 1, wherein the depositing unit has a drum unit that causes the mixture to pass through an opening and fall, and the controller is configured to change a rotation velocity of the drum unit.

4. The sheet manufacturing apparatus according to claim 1, wherein the controller is configured to change a rotation velocity of the rotor of the fibrillating unit.

5. The sheet manufacturing apparatus according to claim 1, further comprising:

a transportation unit including a second mesh belt that transports the deposited material deposited by the depositing unit, wherein the transportation unit has a second air flow generation unit that generates an air flow in a direction crossing a deposition surface where the deposited material is deposited, and, the controller is configured to change a flow velocity of the air flow generated by the second air flow generation unit.

6. The sheet manufacturing apparatus according to claim 1, wherein the additive includes a color material.

7. A control method of a sheet manufacturing apparatus including a fibrillating unit that includes a rotor and fibrillates a raw material including fibers in a gas, an additive supply unit that includes a feeder and supplies an additive, a mixing unit including a blower with a rotating unit disposed downstream relative to the additive supply unit in a transport direction of a fibrillated matter fibrillated by the fibrillating unit, the rotating unit mixing the fibrillated matter and the additive supplied by the additive supply unit, a depositing unit that is disposed downstream relative to the rotating unit in the transport direction of the fibrillated matter and deposits a mixture mixed by the mixing unit, a web forming unit including a mesh belt that transports a deposited material deposited by the depositing unit and including a suction mechanism that sucks the deposited material to the mesh belt, the suction mechanism having a first air flow generation unit that generates an air flow in a direction crossing a deposition surface where the deposited material is deposited, and a controller, the control method comprising: controlling a rotation velocity of the rotating unit of the blower of the mixing unit, and further controlling at least one of a supply amount per unit time from the additive supply unit and a suction force of the suction mechanism, at the controller, to change granularity of a surface of the sheet, wherein a flow velocity of the air flow generated by the first air flow generation unit is changed by the controller.

8. A sheet manufacturing method comprising:

a fibrillating step of fibrillating a raw material including fibers in a gas and obtaining a fibrillated matter;

an additive supplying step of supplying an additive to the fibrillated matter at an additive supply unit includes a feeder;

a mixing step of mixing the fibrillated matter and the additive by using a rotating unit of a blower of a mixing unit and obtaining a mixture, the rotating unit being disposed downstream relative to the additive supply unit in a transport direction of the fibrillated matter;

a depositing step of obtaining a deposited material by depositing the mixture at a depositing unit disposed downstream relative to the rotating unit of the blower of the mixing unit in the transport direction of the fibrillated matter while sucking the mixture to a mesh belt by generating an air flow in a direction crossing a deposition surface where the deposited material is deposited; and controlling a rotation velocity of the rotating unit of the blower of the mixing unit, and further controlling at least one a supply amount per unit time from the additive supply unit and suction force to the mesh belt, to change a granularity of a surface of the sheet, wherein the suction force to the mesh belt is controlled by changing a flow velocity of the air flow generated in the direction crossing the deposition surface.

* * * * *